US007607264B2

(12) United States Patent
Weber

(10) Patent No.: US 7,607,264 B2
(45) Date of Patent: Oct. 27, 2009

(54) LOAD SUPPORTING DEVICE AND METHOD FOR SUPPORTING A BUILDING

(75) Inventor: James D. Weber, Kennewick, WA (US)

(73) Assignee: Pieramid Foundation Systems, Spokane, WA (US)

( * ) Notice: Subject to any disclaimer, the term of this patent is extended or adjusted under 35 U.S.C. 154(b) by 840 days.

(21) Appl. No.: 11/014,263

(22) Filed: Dec. 16, 2004

(65) Prior Publication Data

US 2006/0130415 A1 Jun. 22, 2006

(51) Int. Cl.
*E04B 2/82* (2006.01)
*E04G 1/22* (2006.01)
*E02D 27/00* (2006.01)
*E04G 25/00* (2006.01)

(52) U.S. Cl. ..... 52/169.9; 52/126.1; 52/126.7; 52/DIG. 11; 248/351

(58) Field of Classification Search ..... 52/126.1, 52/126.4, 126.7, 126.6, 169.9, 299, 263, 52/DIG. 11; 248/351, 354, 357
See application file for complete search history.

(56) References Cited

U.S. PATENT DOCUMENTS 4,064,668 A * 12/1977 Carter ..... 52/295
4,866,797 A 9/1989 Vollan
4,872,634 A * 10/1989 Gillaspy et al. ..... 248/354.3
4,895,335 A * 1/1990 Oliver ..... 248/354.3
4,937,989 A * 7/1990 Miyares et al. ..... 52/126.7
4,976,077 A * 12/1990 Tucker ..... 52/126.6
5,363,610 A * 11/1994 Thomas et al. ..... 52/167.8
5,509,237 A * 4/1996 Coulter ..... 52/126.6
5,664,377 A * 9/1997 Angelo et al. ..... 52/295
5,680,732 A * 10/1997 Skouras ..... 52/126.1
6,334,279 B1 * 1/2002 Oliver et al. ..... 52/127.2
6,453,627 B1 * 9/2002 Powers ..... 52/169.12
6,505,447 B1 * 1/2003 Oliver et al. ..... 52/292
6,546,686 B2 * 4/2003 MacKarvich ..... 52/299
6,601,363 B2 * 8/2003 Richard ..... 52/741.15
7,188,842 B2 * 3/2007 Thorpe ..... 280/6.153
2002/0095880 A1 * 7/2002 MacKarvich ..... 52/169.12
2003/0066251 A1 * 4/2003 Cusimano ..... 52/169.9

OTHER PUBLICATIONS

Instruction Manual www.suresafe.com website, Publication Date unknown.

* cited by examiner

*Primary Examiner*—Richard E Chilcot, Jr.
*Assistant Examiner*—Ryan D Kwiecinski
(74) *Attorney, Agent, or Firm*—Wells St. John P.S.

(57) ABSTRACT

A load supporting device, and method for supporting a building in fixed relation relative to the surface of the earth is disclosed and which includes a base member which rests on a supporting surface; and an arm member mounted on the base member and which extends laterally outwardly relative thereto, and wherein the load is supported on each of the base member and the arm member, and further a method for employing the present load supporting device for supporting a building.

11 Claims, 8 Drawing Sheets

LOAD SUPPORTING DEVICE AND METHOD FOR SUPPORTING A BUILDING

TECHNICAL FIELD

The present invention relates to a load supporting device, and method for supporting a building in spaced relation relative to the surface of the earth, and more specifically to a load supporting device which is operable to support the floor of a building, such as a manufactured home, in a fashion not possible heretofore.

BACKGROUND OF THE INVENTION

The steps of positioning a manufactured home on an unimproved site are well known. Typically, the unimproved site is first excavated in order to prepare an appropriate cement pad upon which the manufactured home will rest. Thereafter, the manufactured home is typically elevated above the cement pad by using various supporting means including cinder blocks, wooden posts and the like, and thereafter is fastened to the underlying pad by means of various conventional metal straps in order to secure the manufactured home in place. Following these steps, a decorative skirt is typically placed around the edge of the manufactured home, and which contacts the surface of the earth. In other instances, home owners completely forego the preparation of a cement pad, and rather, elevate the manufactured home in spaced relation relative to the surface of the earth using various supporting means such as cinder blocks and the like. While this method of positioning a home is cost effective, it is somewhat dangerous in geographical areas where the manufactured home might experience high winds as occasioned by thunderstorms, tornados, hurricanes or the like. As of late, mortgage lenders have been reluctant to lend money on manufactured homes unless the home owner first agrees in advance to provide a more elaborate foundation for the manufactured home. The requirements, imposed by lenders in order to secure lending for such manufactured home installation has increased the costs of purchasing, and subsequently locating manufactured homes, to such a degree that these purchasing and related costs become very closely similar to the costs that might be experienced in traditional new home construction.

A load supporting device and method of supporting a building in spaced relation relative to the surface of the earth and which avoids the detriments individually associated with the prior art practices is the subject matter of the present application.

SUMMARY OF THE INVENTION

A first aspect of the present invention relates to a load supporting device which includes a base member which rests on a supporting surface; and an arm member mounted on the base member, and which extends laterally outwardly relative thereto, and wherein the load is supported on each of the base member, and the arm member.

Another aspect of the present invention relates to a load supporting device which includes a base member having a first end which rests on a supporting surface, and an opposite second end, and wherein a portion of the load rests in force transmitting relation relative to the second end of the base member; and an arm member which is mounted on the base member, and which has a distal end which is positioned laterally outwardly and elevationally above the second end of the base member, and wherein a portion of the load rests in force transmitting relation relative to the distal end of the arm member, and wherein the force of the load borne by the second end of the arm member is transmitted to the base member.

Yet further, another aspect of the present invention relates to a load supporting device for supporting a building on a foundation, and which includes a base plate which is fastened to the foundation; a plurality of legs which have a first end which is mounted on the base plate, and a second end, and wherein the legs extend from the base plate and converge at a first apex; a first receiver positioned at the first apex and which is affixed to the second end of the plurality of legs; a first screw threadably adjustable load supporting member borne by the first apex, and which mates with the first receiver, and wherein the building has a peripheral edge, and at least one structural load supporting beam which supports the building, at least in part, and which is positioned beneath the building, and in spaced relation relative to the peripheral edge, and wherein the first screw threadably adjustable load supporting member engages the structural load supporting beam; a plurality of arm members each having a first end which is mounted on one of the plurality of legs, and an opposite, second end, and wherein the second end of the plurality of arms extend laterally outwardly relative to the plurality of legs and converge at a second apex which is disposed in laterally outwardly, and in elevationally offset relation relative to the first apex; a second receiver positioned at the second apex and which is affixed to the second end of the plurality of arm members; a second screw threadable load supporting member which is borne by the second apex, and which mates with the second receiver, and wherein the second screw threadable load supporting member engages the building at a location near the peripheral edge thereof.

Still further, the present invention relates to a method for supporting a building in spaced relation relative to the surface of the earth, and which includes providing a plurality of foundation portions and positioning the respective foundation portions in spaced relation along the surface of the earth; and providing at least one load supporting device which is positioned in rested relation on at least one of the foundation portions, and wherein the building has a floor which is defined by a peripheral edge, and wherein the load supporting device is operable to simultaneously support the floor at a first location which is located adjacent to the peripheral edge, and a second location which is located in spaced relation relative to the peripheral edge.

Further, the present invention relates to a method for supporting a building in spaced relation relative to the surface of the earth and which includes, excavating a plurality of elongated trenches in the surface of the earth, and wherein the building has a floor defined by a peripheral edge, and a length dimension, and wherein the plurality of elongated trenches have a length dimension which is less than about the length dimension of the floor, and which are further disposed in predetermined spaced relation, one relative to the other, across the surface of the earth, and are further spaced inwardly relative to the peripheral edge of the building; depositing a foundation material in the respective plurality of elongated trenches to provide individual foundation portions, and wherein the foundation material forms a substantially rigid upwardly facing surface which has a surface area; providing a first load supporting device which rests on at least one of the foundation portions, and which simultaneously supports a portion of the floor of the building at a first location which is adjacent to the peripheral edge, and a second location which is positioned inwardly and in spaced relation relative to the peripheral edge; providing a second load supporting device which rests on at least one of the foundation portions, and which supports a portion of the floor of the building at a location which is positioned inwardly relative to the peripheral edge; adjusting the height of the first or second load supporting devices so as to support the floor of the building in a selected orientation relative to the surface of the earth; and attaching at least one of the first or second load supporting devices to the underlying foundation portion.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
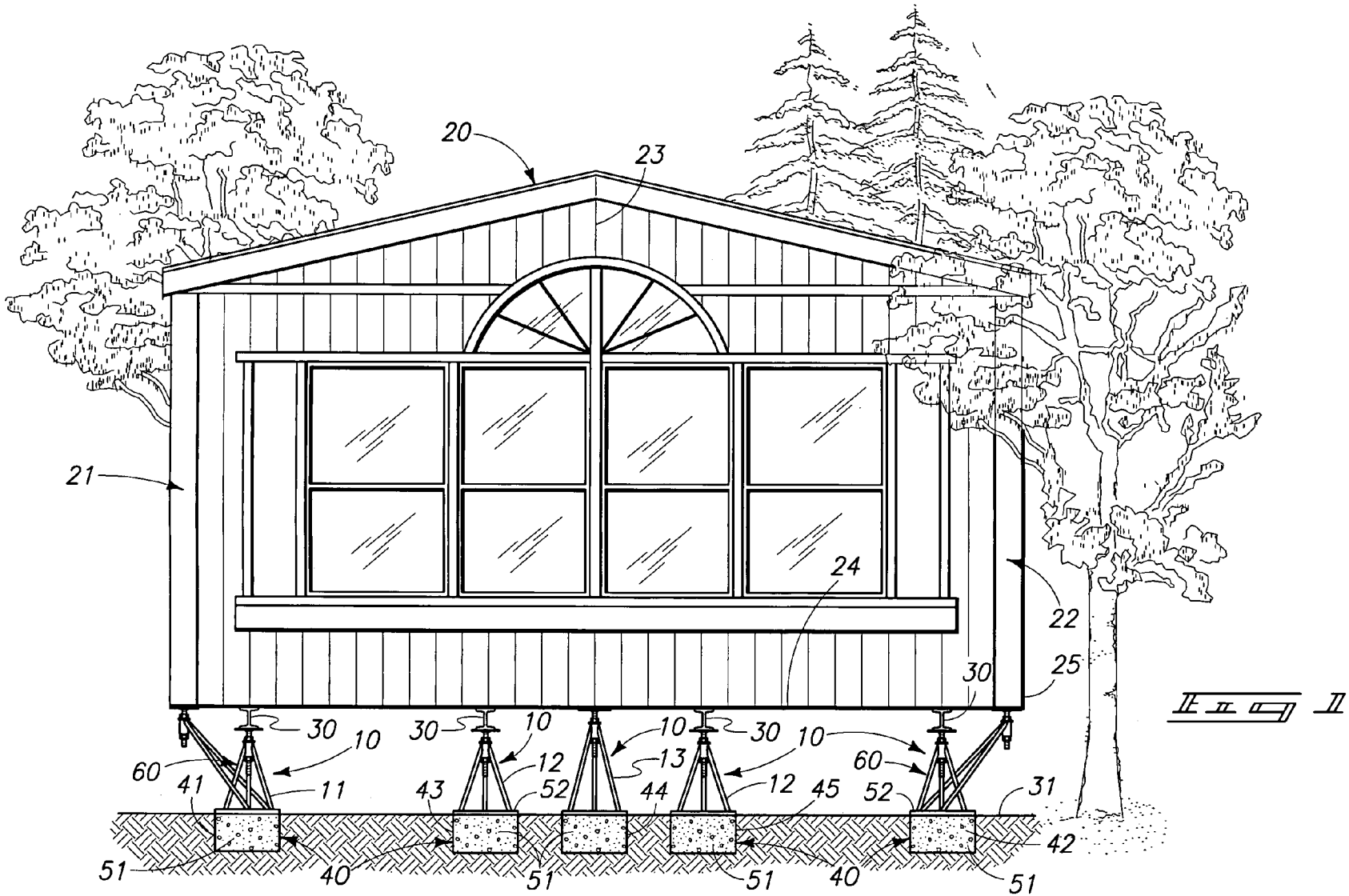
FIG. 1 is a side elevation view showing the load supporting device and method for supporting a building in accordance with the teachings of the present invention.
Figure 6:
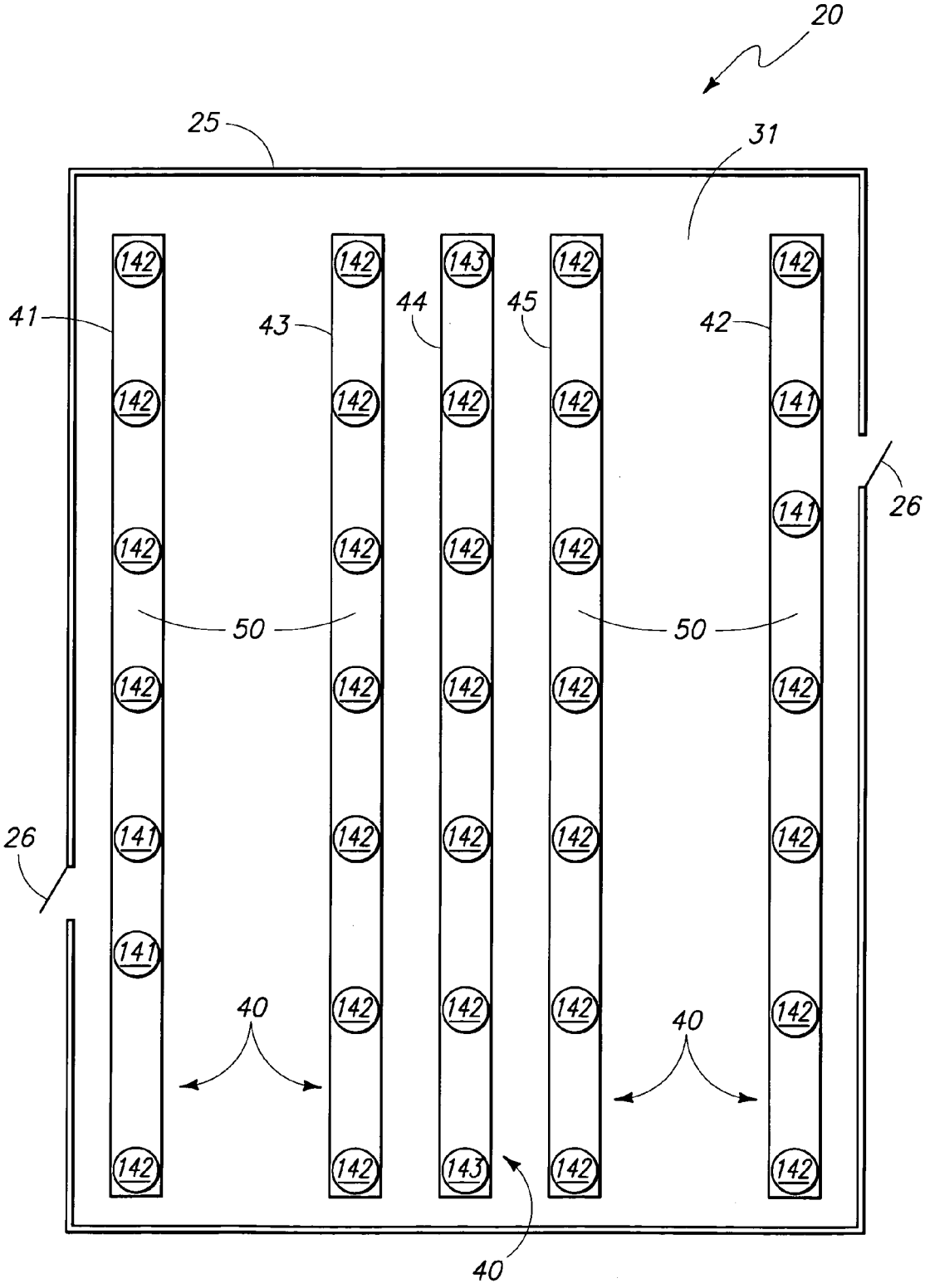
FIG. 6 is a graphical depiction showing the foundation portions and deployment of the various forms of the invention relative to the floor of a building.

The present load supporting device and method for supporting a building in spaced relation relative to the surface of the earth is best understood by a study of FIG. 1 and following. Several forms of the load supporting device are generally indicated by the numeral 10 in that view. As should be understood, the load supporting device 10 includes a first form 11, a second form 12 and a third form 13 each of which will be individually described hereinafter. As seen in FIG. 1, a building 20, such as a manufactured home, which has a first and second portion 21 and 22, respectively is shown. It will be understood, in home construction of this type (manufactured homes), the first and second portions 21 and 22 of the building 20 are brought together at the building site and connected or otherwise joined together at a marriage line 23. The building 20 has a floor 24 which is defined by a peripheral edge 25, as seen in FIG. 1 and FIG. 6, respectively. Still further, the manufactured home has several doors generally indicated by the numeral 26 as seen in FIG. 6, and which are located about the peripheral edge of the building 20. As seen in FIG. 1, a plurality of support beams 30 are positioned beneath the building and support the floor 24 so that the building 20 can be supported in spaced relation relative to the surface of the earth, and which is generally indicated by the numeral 31. The support beams may be fabricated of wood or metal. As best understood, by a study of FIG. 6, the support beams 30 extend along the major dimension of the floor to support the floor 24 and structure thereabove. As seen by reference to FIG. 1, the support beams 30 are positioned in inwardly spaced relation and in substantially parallel relation relative to the peripheral edge 25.

Figure 7:
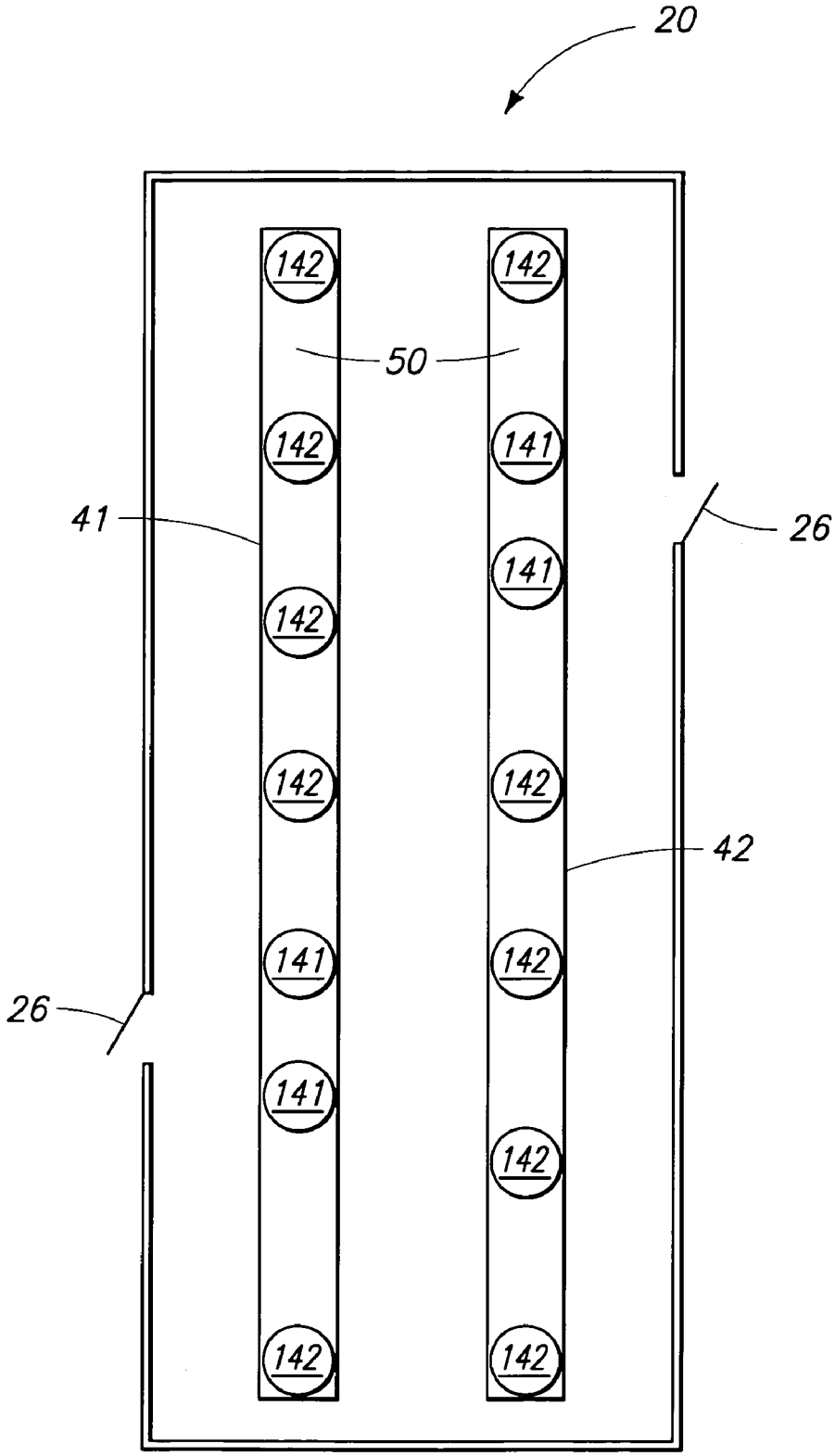
FIG. 7 is a graphical depiction showing the foundation portions and deployment of the various forms of the invention relative to the floor of a building.
Figure 8:
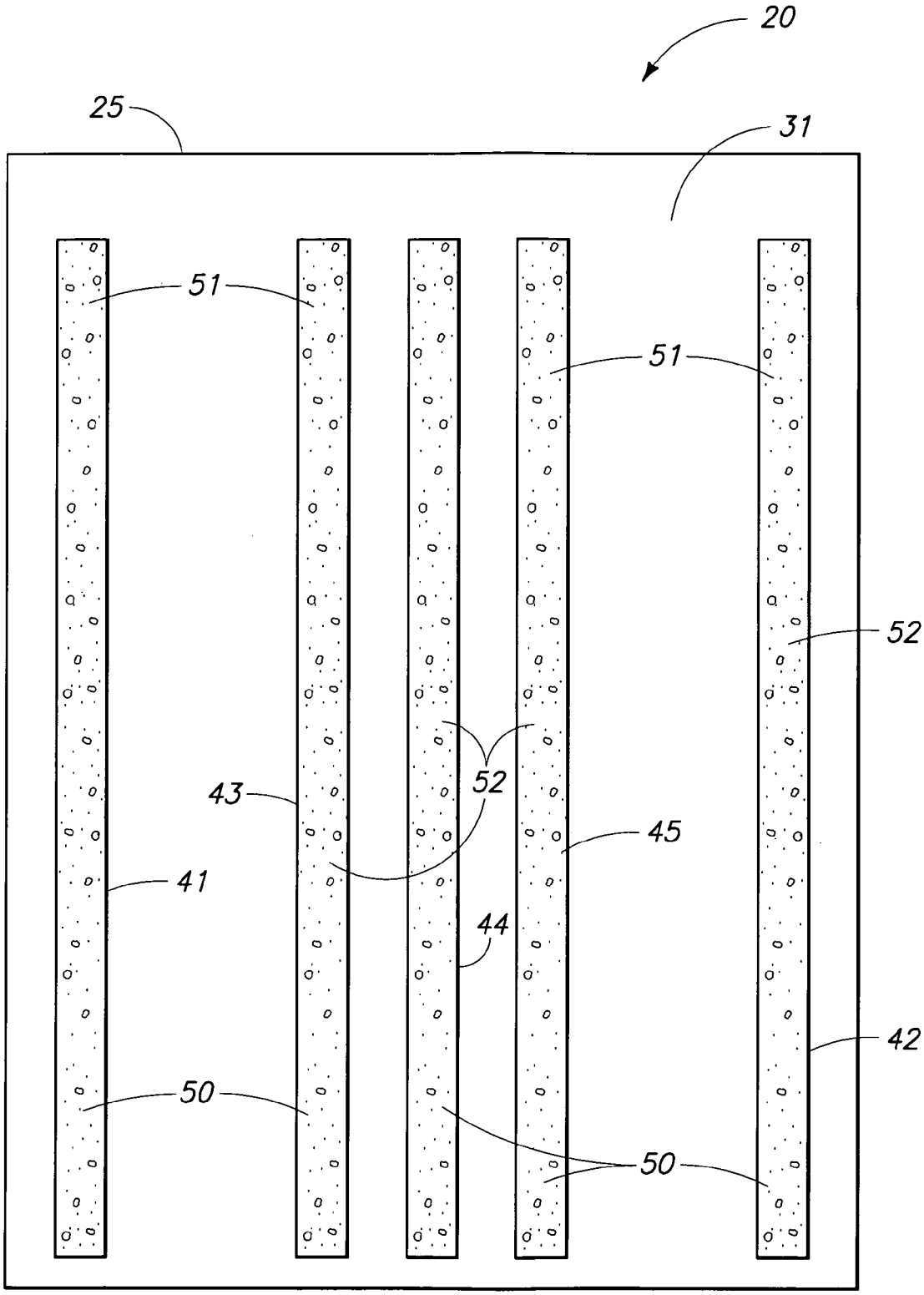
FIG. 8 is a plan view of the foundation portions as might be prepared in anticipation of positioning a building thereon, and which is useful in the present invention.

Referring now to FIGS. 1, 6, 7 and 8, it will be seen that the method of the present invention includes as a first step, excavating a plurality of elongated trenches 40 in the surface of the earth 31. The elongated trenches 40 as shown herein include first, second, third, fourth and fifth trenches as indicated by the numerals 41-45, respectively. With respect to FIG. 7, it should be understood that this view depicts the floor 24 of a manufactured home 20 which does not include a first and second portion 21 and 22. These homes are typically referred to as "single-wide" manufactured homes. However, it will be recognized that the principles of the present invention apply equally to both "double-wide" (FIGS. 1 and 6) as well as "single-wide" (FIG. 7) manufactured homes. Still further, this device and method can be applied to so-called "triple wide" or multi-sectional manufactured homes. Referring still to FIGS. 6, 7 and 8, it will be recognized that the first and second elongated trenches 41 and 42 are positioned adjacent to, but in spaced relation relative to the peripheral edge 25 of the building 20. Still further, the third, fourth and fifth trenches are positioned inwardly therefrom, it being understood that the fourth elongated trench 44 is positioned in substantially coaxial alignment with and located along the marriage line 23, as seen in FIG. 1. Yet further, it should be understood that the third and fifth elongated trenches are positioned substantially under one of the supporting beams 30 which supports the floor of the building 20 (FIG. 1). As will be recognized by a study of FIG. 8, the building has a major length dimension, and a minor transverse dimension. It will be seen by a study of the several views that the elongated trenches each have a length dimension which is equal to, or less than, the length dimension of the building 20 which is supported on same. Still further and as seen, the elongated trenches are disposed in predetermined spaced relation one relative to the other across the surface of the earth 31, and are further spaced inwardly relative to the peripheral edge 25 of the building 20. In the present invention, which includes the methodology of positioning a building 20 in spaced relation relative to the surface of the earth 31, the methodology includes a step of depositing a foundation material 50 such as cement or concrete in the respective plurality of elongated trenches 40 to provide individual foundation portions 51 which have an upwardly facing surface 52. As should be understood, the building 20, which has the floor 24, has a floor surface area, and the foundation portions 51 have a collective upwardly facing surface area of at least about 20% of the surface area of the floor. Still further, the average weight of the respective foundation portions is at least about 5,000 pounds. Therefore, in the arrangement as seen in FIG. 1, the collective weight of the foundation portions is at least about 30% of the overall weight of the building 20 which is supported on same but this could be more. In order to determine the length, and width of the respective plurality of trenches 41-45, the methodology of the present invention includes a step of calculating the square footage of the floor 24 of the building 20, and then conducting the excavation in a manner so as to provide a collective upwardly facing surface area for the plurality of elongated trenches 40 which is at least about 20% of the building floor surface area. In the arrangement as seen in FIG. 1, for example, it will be understood that the respective foundation portions 51 appear to be substantially level, one relative to the other. However, it should be recognized, that in the practice of the present invention that the foundation portions need not be level, either individually or with respect to adjacent portions for the present methodology to be operational. Still further, and while the respective portions are shown in spaced relationship, one to another, it may be desirable to interconnect the respective portions.

Figure 2:
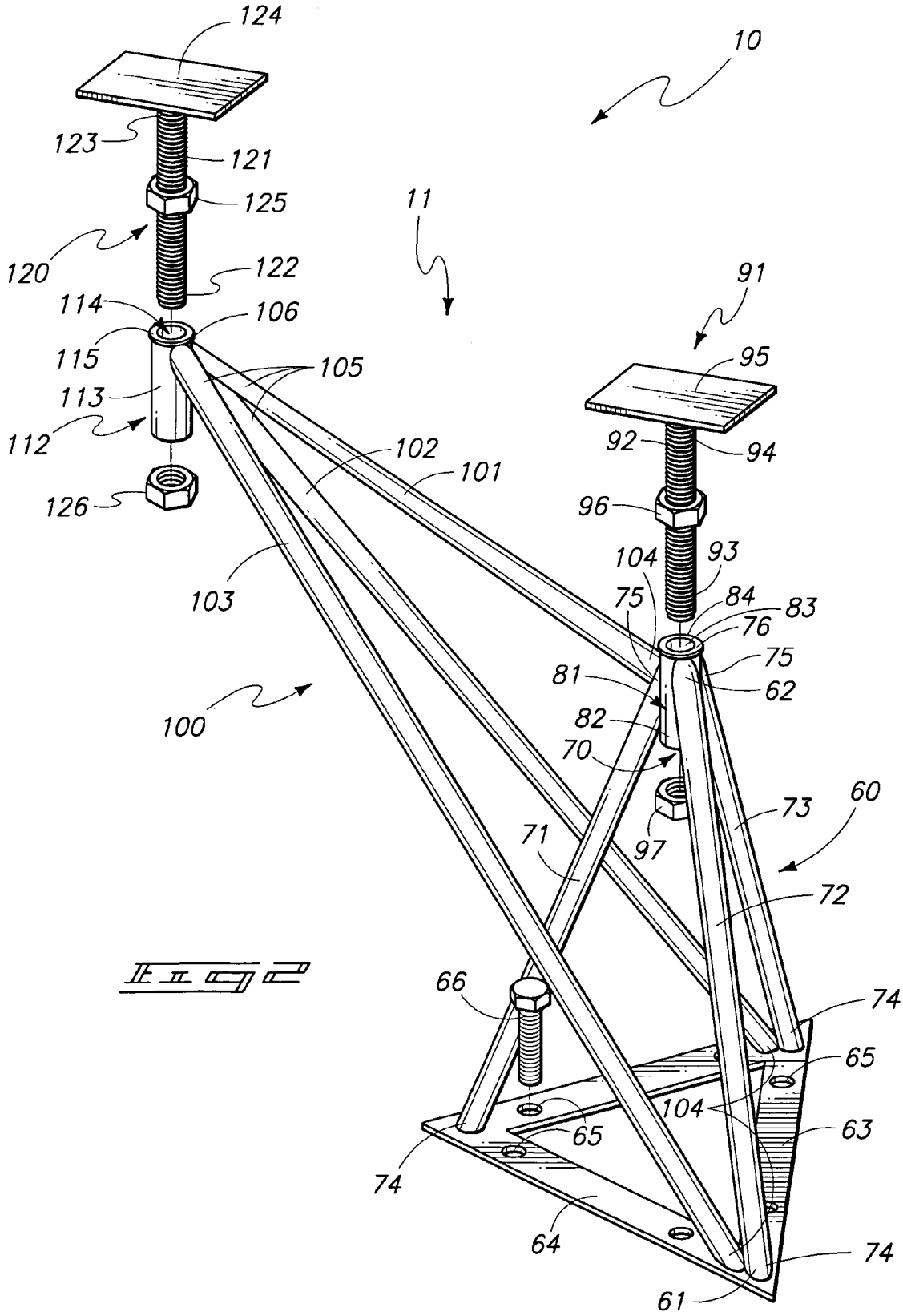
FIG. 2 is a perspective, exploded, side elevation view of a first form of the load supporting device of the present invention.

The first form 11 of the load supporting device of the present invention 10 is seen most clearly by a study of FIG. 2. As illustrated therein, the first form 11 of the load supporting device 10 generally includes a base member 60 which rests on a supporting surface such as the upwardly facing surface 52 of one of the foundation portions 51, as seen most clearly in FIG. 1. The base member 60 generally has a first end 61, and an opposite second end 62. As seen by a study of FIG. 1, the base member rests on the upwardly facing supporting surface 52 such as a foundation portion 51, and the force of a load such as from the building 20 is transmitted to the base member 60 and into the underlying supporting surface. As seen in FIG. 2, the base member 60 is substantially frustum shaped, and a base plate 63 is provided, and which is mounted on the first end 61. The base plate 63 has a shape which is selected from the group which comprises circles, squares, triangles, pentagons, hexagons or octagons. As seen in FIG. 2, the base plate has a shape of a substantially equilateral triangle. The base plate 63 has an upwardly facing surface 64, and a plurality of apertures 65 are formed in the upwardly facing surface and extend therethrough. The respective apertures 65 are operable to receive individual fasteners 66 therethrough. These same fasteners are operable to securely affix the base plate to the underlying supporting surface which is typically the upwardly facing surface 52 of one of the foundation portions 51.

Still referring to FIG. 2, it will be seen that the base member 60 includes at least three legs, herein designated as first, second and third legs 71, 72 and 73, respectively. Depending upon the shape of the base plate 63, more legs may be required. However for the triangular shaped base plate as seen in FIG. 2, three legs are provided. Each of the legs has a first end 74, which substantially rests on the supporting surface such as the upwardly facing surface 52 of one of the foundation portions 51, and an opposite second end 75. Each of the second ends are joined together substantially at a first apex which is indicated by the numeral 76. Mounted at the first apex 76 is a first receiver which is generally indicated by the numeral 81. The first receiver has an elongated main body 82 (FIG. 3) which is substantially oriented along a vertical line of reference. The elongated main body 82 has a longitudinally extending passageway 83 which passes or otherwise extends therethrough. Still further, the first receiver 81 has a flange which is generally indicated by the numeral 84. As seen by reference to FIG. 3, the longitudinally extending passageway has a substantially smooth bore, however in some forms of the invention this longitudinally extending passageway may be threaded in order to threadably mate with an adjustable load supporting member which will be discussed in greater detail hereinafter. Still further, it should be understood that in some forms of the invention, a transverse passageway may be formed through the main body 82 in order to receive a transversely mounted pin or shaft which may be utilized to either adjustably position the adjustable load supporting member, or further to lock the load supporting member in place. It should be understood that the base member 60 can be fabricated to various heights. The range of heights of the base portions may be anywhere from 10 inches to several feet depending upon the building 20 which is positioned thereon. The load supporting devices 10, as shown, can support loads of at least 300 pounds to greater than 12,000 pounds depending on the gauge of materials which are used to fabricate same.

Figure 3:
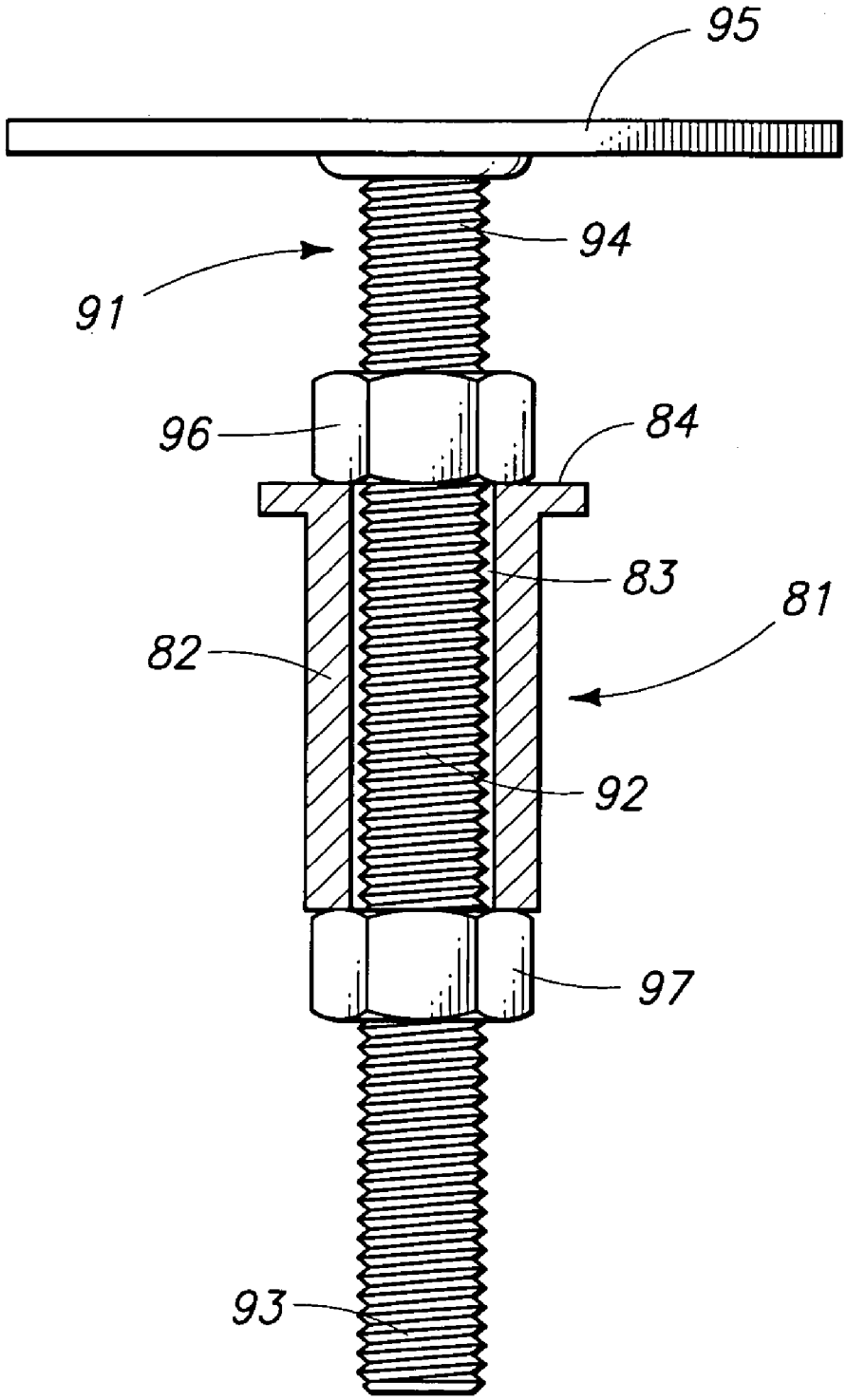
FIG. 3 is a longitudinal, vertical sectional view of an adjustably positionable load supporting member which forms a feature of the present invention.

Still referring to FIGS. 2 and 3, the first form 11 of the load supporting device includes an adjustable load supporting member which is generally designated by the numeral 91, and which further matingly cooperates with the first receiver 81. The adjustable load supporting member as seen in FIGS. 2 and 3 includes a shaft portion 92 which is illustrated as a threaded shaft. The shaft position has a first end 93 and an opposite second end 94. As should be appreciated however, in some forms of the invention the shaft may be unthreaded and further have a plurality of transversely disposed passageways formed therethrough. As discussed above, the adjustable load supporting member 91 could be adjusted, in this form of the invention, by means of orienting the transverse passageways of the shaft in substantially coaxial orientation relative to transversely disposed passageways formed in the elongated main body 82 of the first receiver 81. Thereafter, a locking pin (not shown) may be received through the coaxially aligned passageways thereby locking or adjusting the load supporting member in a given orientation which extends generally longitudinally outwardly relative to the first receiver 81. However, as illustrated in FIGS. 2 and 3, the load supporting member 91 has a screw threadably adjustable load supporting member. As illustrated, the threaded shaft portion 92 has an outside diametral dimension which is less than the inside diametral dimension of the longitudinally extending passageway 83. Therefore, the shaft portion 92 can be telescopingly received in same. Mounted on the second end 94 of the shaft portion 92 is an engagement plate 95. The engagement plate 95 is operable to be positioned in supporting relation there against one of the beams 30 which support the floor 24 of the building 20. As best seen in FIG. 3, the adjustable load supporting member 91 includes a first adjustment nut 96 which is threadably received about the threaded shaft portion 92. It will be understood that the threadable advancement of the first adjustment nut 96 along the shaft 92, as it rests against the flange 84 has the effect of causing the engagement plate 95 to be positioned at various locations which are in spaced relation relative to the first receiver 81. Once the engagement plate is located in an appropriate elevated position so as to place the floor 24 in an appropriate orientation relative to the surface of the earth 31, then the second locking nut 97 is advanced along the threaded shaft 92 so as to engage the first receiver 81, and secure the engagement plate 95 in a substantially fixed and locked position. The engagement plate 95 may be secured to the support beams 30 by means of fasteners of various types. If the support beam 30 is metal, such as seen in FIG. 1, the support plate may be spot welded to the support beam. On the other hand, the plate may further be attached to the beam 30 by means of a clamp which is well known in the art. Still further, the engagement plate 95 may include a flange portion, not shown, and which is operable to be oriented along the side of the support beam in order to appropriately position the engagement plate 95 substantially centrally along one of the beams 30. If the beam 30 is fabricated from wood, a suitable screw (not shown) may secure the engagement plate 95 to the wood beam.

Figure 4:
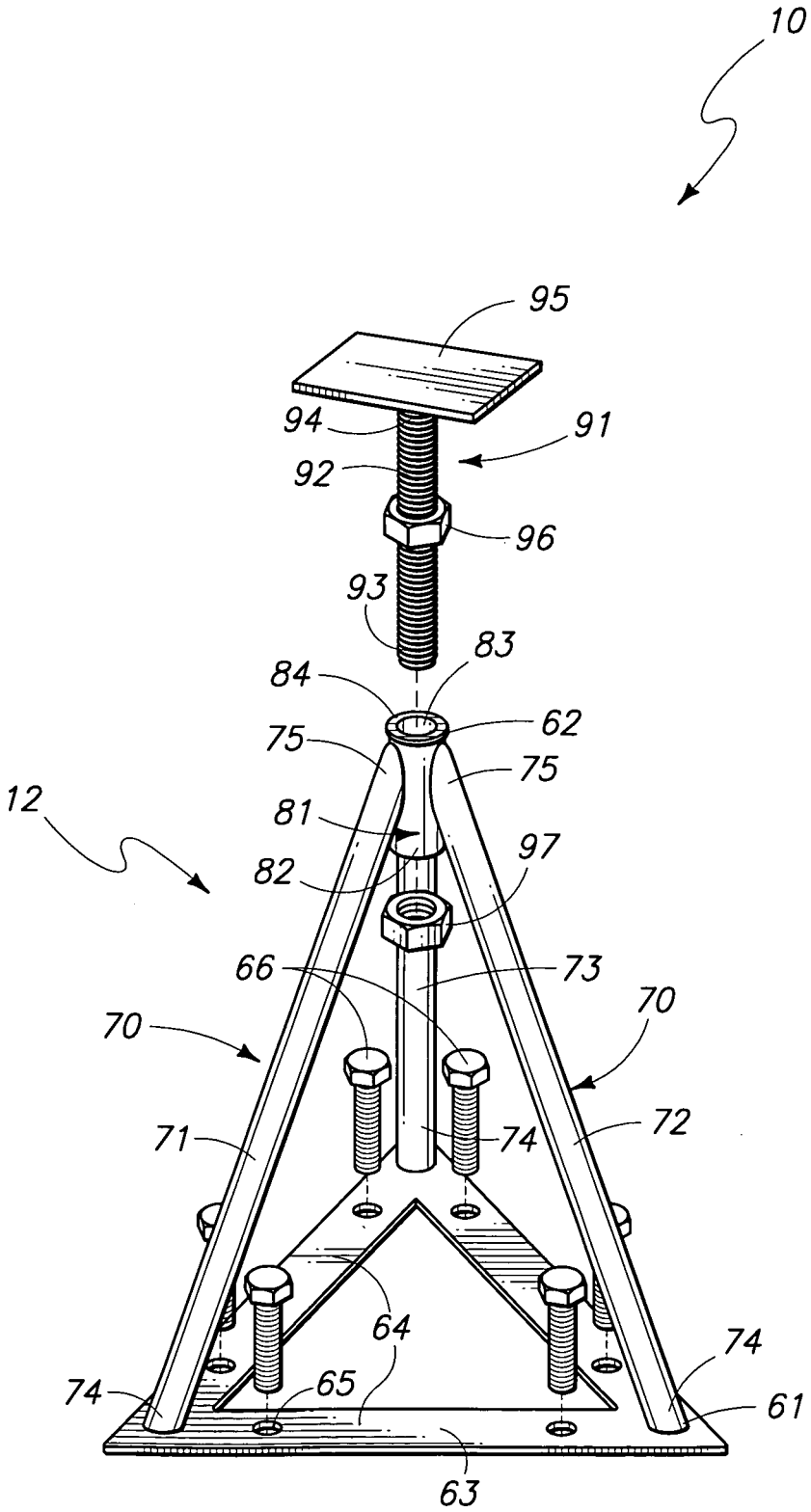
FIG. 4 is a perspective, exploded, side elevation view of a second form of a load supporting device and which is the subject of the present invention.

Referring now to FIG. 4, the second form 12 of the load supporting device 10 is illustrated. It will be recognized that the second form 12 of the load supporting device 10 merely includes the base member 60, which was previously described with respect to the first form of the invention 11. Therefore, for purposes of this application, the individual portions of the second form of the invention bear similar numbers to that seen with respect to the first form of the invention. The second form of the invention 12, is similarly operable, as seen in FIG. 1 to support a load as might be occasioned by means of being positioned therebelow a beam 30 of a building 20, and disposed in rested relation on one of the foundation portions 51. The second form 12 would similarly be fastened to the foundation portion 51 as earlier described, and would be adjustably positioned relative to the beam 30 in a similar fashion. As will be recognized by comparing FIGS. 2 and 3, the second form of the invention 12 does not include certain features of the first form 11 which are further described in the paragraphs which follow.

Referring again to the first form of the invention 11 as seen most clearly by reference to FIG. 2, the first form 11 of the load supporting device 10 includes an arm member which is generally indicated by the numeral 100, and which is mounted on the base member 60, and which extends laterally outwardly relative thereto. As seen by reference to FIG. 1, the load, which may comprise a portion of the peripheral edge 25, of the building 20, is supported by the first form of the invention 11 on each of the base member 60, and the arm member 100. The arm member 100 is formed of first, second and third portions, or arm members 101, 102 and 103, respectively. Each of the first, second and third portions or arm members has a first end 104 which is mounted on the base portion 60, and an opposite second end 105. Each of the second ends are joined together to form a second apex 106. In the arrangement as shown in FIG. 2, the first end 104 of two of the three portions, that is 102 and 103, are individually mounted near the first end 74 of two of the three legs, that is 72 and 73, respectively. Still further, the first end 105 of the remaining portion, that is 101, is mounted on the base portion 60 and is positioned near the first apex 76. In particular, it will be seen that the portion or arm member 101 which is affixed to the first apex 76 is attached by welding or the like to the first receiver 81. In the arrangement as seen in FIG. 2, the first and second apex 76 and 106, respectively, are positioned, one relative to the other in horizontally spaced relation at a distance of about 12 inches to about 24 inches. Still further, the first and second apex 76 and 106, respectively, are positioned one relative to the other in offset vertically spaced relation at a distance of about 0 inches to about 36 inches. In other words, the first apex 76 is positioned a given distance above the surface of the earth 31, or foundation portion 51, and the second apex 106 is positioned at a second distance above the same surface. In the arrangements as seen in the drawings, it should be understood that these distances, that is, between the first and second apexes may be, on the one hand, substantially equal, unequal, or the second distance, that is, the distance above the supporting surface 52, for example, to the second apex 106 may be greater than the first distance, that is, the distance between the supporting surface and the first apex 76.

As seen in FIG. 2, the first form 11 of the load supporting device 10 includes a second receiver 112, which is positioned at the second apex 106, and which is affixed to each of the second ends 105 of the plurality of portions or arms 101, 102 and 103, respectively. As appreciated by a study of FIG. 2, the second receiver 112 is constructed very similarly to that seen with respect to the first receiver 81. That is, the second receiver has an elongated main body 113, which defines a longitudinally extending passageway 114, and which has a substantially smooth bore. However, as earlier discussed, this passageway may be threaded, and modified in the way earlier discussed with respect to the first receiver 81. Still further, a flange 115 is mounted on the elongated main body. The first form of the invention 11 includes a second adjustable load supporting member which is herein illustrated as a screw threadable load supporting device 120 which is borne by the second apex 106, and which telescopingly mates with or is received within the second receiver 112. The second screw threadable load supporting member 120 engages the building 20 near the peripheral edge 25 thereof, as seen in FIG. 1. The second adjustable load supporting member 120 includes a shaft portion 121 which has a first end 122, and an opposite second end 123. An engagement plate 124 is affixed to the second end 123 and is operable to be positioned thereagainst or adjacent to the peripheral edge 25 of the floor 24. Similar to the first adjustable load support member 91, a first adjustment nut 125 is provided, and which is operable to be threadably advanced along the shaft portion 121 so as to appropriately position the engagement plate in spaced relation and in longitudinally outwardly relation relative to the second receiver 112, and the passageway 114. Still further, a second locking nut 126 may optionally be provided, and which is operable to fixedly position or otherwise lock the engagement plate 124 in a fixed location relative to the second receiver 112. As seen in FIG. 1, the engagement plate 124 supports a portion of the peripheral edge 25 of the floor 24, and the force of the peripheral edge is transmitted to the first end 61 of the base member 60. As should be understood, the first and second load supporting members 91 and 120 are adjusted in given positions above the surface of the earth 31, for example, so as to position the floor 24 in an appropriate orientation. In the drawing as seen in FIG. 1, the engagement plate 124 may be optionally affixed to the peripheral edge of the floor, or further the floor may just rest in supported relation thereon.

Figure 5:
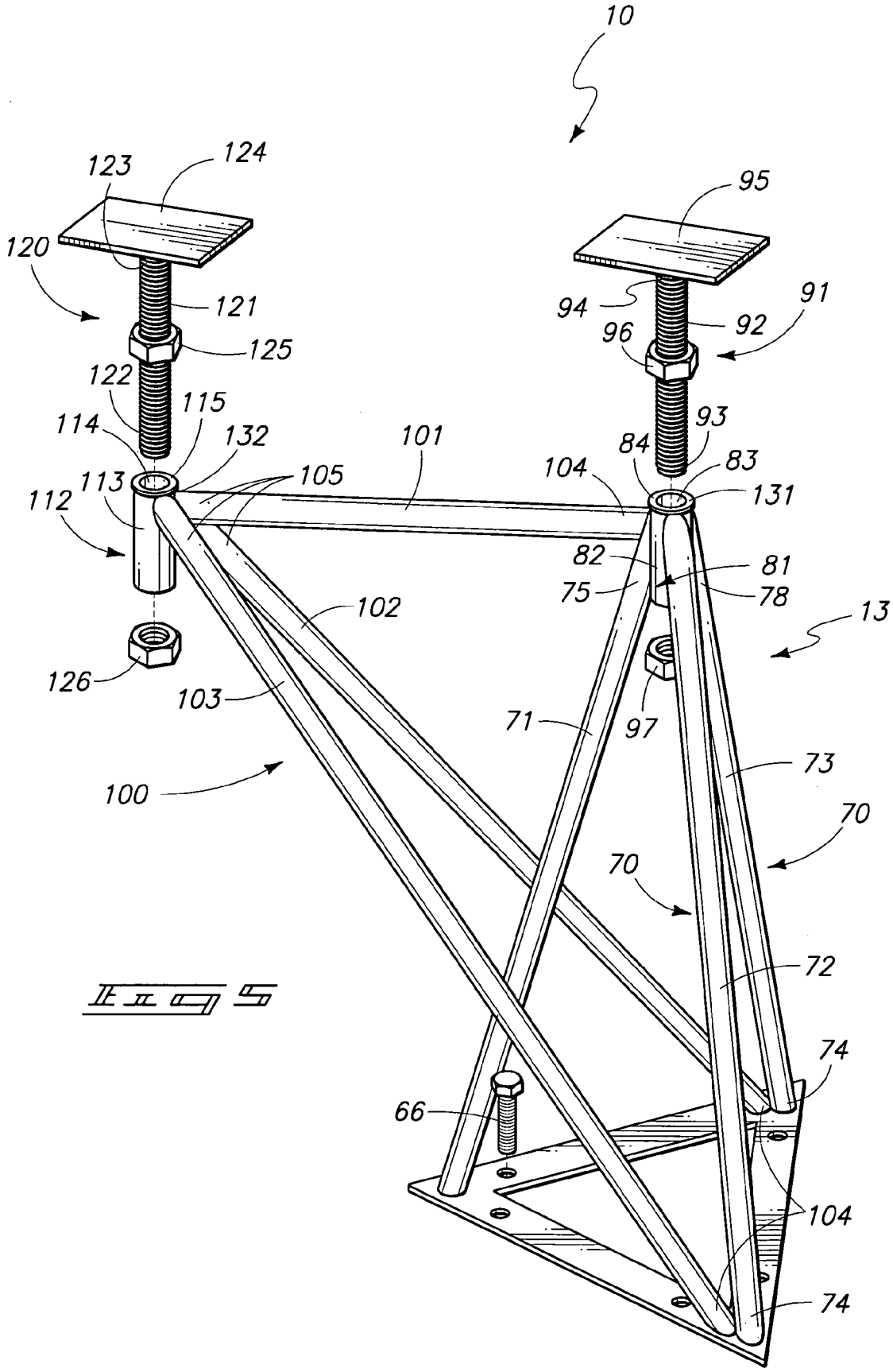
FIG. 5 is a perspective, exploded, side elevational view of a third form of a load supporting device and which is the subject matter of the present invention.

Referring now to FIG. 5, the third form 13 of the load supporting device 10 is herein illustrated in an exploded view therein. As should be understood, the third form 13 of the load supporting device 10 rests on at least one of the foundation portions 51, and simultaneously supports the peripheral edge 25, of each portion 21 and 22 of the building 20 at a first location which is near the peripheral edge, and in substantially coaxial alignment with the marriage line 23, and further simultaneously supports each of the building portions 21 and 22 at a second location which is disposed in spaced relation relative to the peripheral edge 25. As seen by reference to FIG. 1, the third form 13 of the invention 10 is positioned in substantially coaxial alignment along the marriage line 23 of the building 20, and rests upon the foundation portion 51 which is deposited in the fourth trench 44. In the arrangement as shown in FIG. 5, similar parts or portions of the invention bear the same numbers as described with respect to the first form 11 of the invention 10 as seen in FIG. 2. By comparing FIG. 2 and FIG. 5, it will be seen that the arm member 100 is disposed in a different orientation from that seen in FIG. 2. More specifically, in the third form 13 of the invention 10, the base portion 60 is now defined by a first apex 131; and the arm portion or arm member 100, is defined by a second apex 132. As seen in FIG. 5, it will be appreciated that the first and second apex 131 and 132 are positioned in substantially horizontal, laterally offset relation one relative to the other. As with the first form of the invention, first and second receivers 81 and 112 are provided, and first and second load supporting members 91 and 120 matingly cooperate with same. The individual load supporting members 91 and 120 may be adjustably positioned in spaced, substantially vertically extending relation relative to the respective receivers in order to correctly position the floor 24, of each of the portions 21 and 22, along the marriage line 23, and in a given orientation relative to the surface of the earth 31. As was discussed with the first form 11 of the invention 10, the base plate 63 which forms a portion of the base member 60 is affixed to the upwardly facing surface 52 of the foundation portion 51 which is deposited within the fourth trench 44.

Referring now to FIGS. 6 and 7, the applicant has illustrated the positioning of the various forms of the invention 11, 12 and 13 with respect to a "double wide" manufactured home arrangement, that is, a manufactured home having two portions 21 and 22 as seen in FIG. 6, and a so-called "single wide" construction, as shown in FIG. 7. As seen in FIG. 6, one possible arrangement for positioning the various forms of the invention 10 is shown, and wherein the locations for the first form 11 of the invention (FIG. 2) relative to the floor 24 of the building 20 is indicated by the numeral 141. As shown herein, the first form 11 of the invention 10 is operable to support the floor 24, as well as the peripheral edge 25 of the building 20 in the vicinity of where the doors 26 are provided. Still further, the location where the third form 13 of the invention 10 (FIG. 5) is positioned and which is operable to support both portions 21 and 22 of the building 20 along the marriage line 23 are indicated by numeral 143. All other locations for supporting a "double wide" building 20 would typically utilize the second form 12 (FIG. 4) of the invention. The locations for the second form of the invention are designated by the numeral 142.

Referring now to FIG. 7, in a so-called "single wide" building 20, it will be noted again that the first form of the invention 11 is located at the positions 141 and which are adjacent to the doorways 26; and the second form of the invention is located at the positions labeled 142. Of course any number of different combinations of the first, second and third forms of the invention 11, 12 and 13 may be utilized to support various portions of the floor 24 depending upon the characteristics of the building 20 and the loads which might be experienced in specific regions of the floor 24.

In the methodology of the present invention for supporting a building 20 in spaced relation relative to the surface of the earth 31, the method includes, as a first step, providing a plurality of foundation portions 51, and positioning the respective foundation portions in spaced relation along the surface of the earth 31. Still further, the present invention includes a step of providing at least one load supporting device 10 which is positioned in rested relation on at least one of the foundation portions 51, and wherein the building 20 has a floor 24 which is defined by a peripheral edge 25. In the present methodology, the load supporting device 10 is operable to simultaneously support the floor 24 at a first location which is located adjacent to the peripheral edge 25 and a second location which is located in spaced relation relative to the peripheral edge. More specifically, the method for supporting a building 20 in spaced relation relative to the surface of the earth 31 includes as a first step excavating a plurality of elongated trenches 40 in the surface of the earth 31, and wherein the building 20 has a floor 24 which is defined by a peripheral edge 25, and a length dimension, and wherein the plurality of elongated trenches 40 have a length dimension which is less than the length dimension of the floor 24, and are further disposed in predetermined spaced relation one relative to the other, and across the surface of the earth 31, and are further spaced inwardly relative to the peripheral edge 25 of the building 20. In the methodology as described above, the method also includes a step of depositing a foundation material 50 in the respective plurality of trenches 40 to provide individual foundation portions 51. The foundation material forms a substantially rigid upwardly facing surface 52 which has an upwardly facing surface area.

In the methodology as described, the method also includes a further step of providing a first load supporting device 11 which rests on at least one of the foundation portions 51, and which simultaneously supports a portion of the floor 24 of the building 20 at a first location which is adjacent to the peripheral edge 25, and at a second location which is positioned inwardly, and in spaced relation relative to the peripheral edge 25. In the method as described above, the method includes another step of providing a second load supporting device 12, which rests on at least one of the foundation portions 51, and which supports a portion of the floor 24, of the building 20, at a location which is positioned inwardly relative to the peripheral edge 25 thereof. The present methodology also includes a step of adjusting the height of the first or second load supporting devices 11 and 12 so as to support the floor 24 of the building 20 in a selected orientation relative to the surface of the earth 31; Still further, the method of the present invention includes a step of attaching at least one of the first or second load supporting devices 11 and/or 12 to the underlying foundation portion 51. In the methodology as described, the method also includes a step of attaching at least one of the first or second load supporting devices to the floor 24 of the building 20. In the methodology as described, the building 20 may comprise at least two portions 21 and 22, respectively, and wherein each of the portions has a peripheral edge 25. Further, the first and second portions are joined together at a marriage line 23. When such a building is supported by the present invention 10, the methodology includes a further step of providing a third load supporting device 13 which rests on at least one of the foundation portions 51, and which simultaneously supports the peripheral edge 25 of the building 20 at a first location which is near the peripheral edge 25 thereof, and further simultaneously supports each of the building portions 21 and 22 at a second location which is disposed in spaced relation relative to the peripheral edge. In the methodology as described above, the third load supporting device 13 would be affixed to the underlying foundation portion 51. Still further, in the methodology as described, the third load supporting device 13 may be affixed to the floor 24 of the building 20, and further the methodology as described may include a step of adjusting the height of the third load supporting device 13 so as to position the floor 24 of the building 20 in a given orientation relative to the surface of the earth 31. In the method of supporting a building 20 in spaced relation relative to the surface of the earth 31, the methodology may include another step of calculating the square footage of the floor 24 of the building 20; and conducting the excavation of the elongated trenches 40 in a manner so as to provide a collective upwardly facing surface area for the plurality of the elongated trenches 40 which is at least about 20% of the building floor surface area.

Therefore it will be seen that the present invention provides a load supporting device, and a means for supporting a building in fixed relation relative to the surface of the earth and which provides many advantages over the prior art practices which have been utilized heretofore. Among the chief advantages provided, is that the homeowner is no longer required to provide a substantially continuous foundation pad in order to appropriately site a manufactured home. Still further, in the arrangement as shown, individual foundation portions 51 may be provided, and the manufactured home or building 20 may be affixed to the foundation portions utilizing the load supporting device 20 in a manner which provides a firm attachment to the surface of the earth 31, but does not require that the individual foundation portions 51 be placed in a level orientation one relative to the other. The adjustment provided by means of the various forms of the invention 11, 12 and 13 provides a convenient means whereby the floor 24 of the building may be leveled to provide a satisfactory installation.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A load supporting device for supporting a building on a foundation, comprising:

a base plate which is fastened to the foundation;

a plurality of legs which have a first end which is mounted on the base plate, and a second end, and wherein the legs extend from the base plate and converge at a first apex;

a first receiver positioned at the first apex and which is affixed to the second end of the plurality of legs;

a first screw threadably adjustable load supporting member borne by the first apex, and which mates with the first receiver, and wherein the building has a peripheral edge and at least one structural load supporting beam which supports the building, at least in part, and which is positioned beneath the building, and in spaced relation relative to the peripheral edge, and wherein the first screw threadably adjustable load supporting member engages the structural load supporting beam;

a plurality of arm members each having a first end which is non-pivotally affixed near one of the plurality of legs, and an opposite, second end, and wherein the second end of the plurality of arms extend laterally outwardly relative to the plurality of legs and converge at a second apex which is disposed in laterally outwardly, and in elevationally offset relation relative to the first apex;

a second receiver positioned at the second apex and which is non-pivotally affixed to the second end of the plurality of arm members;

a second screw threadable load supporting member which is borne by the second apex, and which mates with the second receiver, and wherein the second screw threadable load supporting member engages the building at a location near the peripheral edge thereof, and wherein the entire force of the load borne by the second ends of the plurality of arm members is transmitted only to the base plate.

2. A load supporting device as claimed in claim 1, and wherein the foundation has a peripheral edge which is positioned beneath and in substantially vertical alignment relative to the peripheral edge of the building.

3. A load supporting device as claimed in claim 1, and wherein the foundation has a peripheral edge which is positioned beneath, and in inwardly vertically offset relation relative to the peripheral edge of the building.

4. A load supporting device as claimed in claim 1, and wherein the first and second apex are positioned, one relative to the other in horizontally spaced relation at a distance of about 12 inches to about 24 inches.

5. A load supporting device as claimed in claim 1, and wherein the first and second apex are positioned, one relative to the other, in offset vertically spaced relation at a distance of about 0 inches to about 36 inches.

6. A load supporting device as claimed in claim 1, and wherein the first screw threadably adjustable load supporting member is fastened to the at least one load supporting beam, and wherein the load supporting device can support a load of at least about 300 pounds.

7. A load supporting device as claimed in claim 6, and wherein load supporting device can support a load of at least about 300 to about 12,000 pounds.

8. A load supporting device as claimed in claim 1, and wherein the foundation is substantially level.

9. A load supporting device as claimed in claim 1, and wherein the foundation is discontinuous and not level.

10. A load supporting device as claimed in claim 1, and wherein the building has a floor which has a surface area, and wherein the foundation has a surface area of at least about 20% of the surface area of the floor.

11. A load supporting device as claimed in claim 1, and wherein the building has a weight, and wherein the foundation has a weight which is at least about 30% of the weight of the building.

* * * * *

UNITED STATES PATENT AND TRADEMARK OFFICE

CERTIFICATE OF CORRECTION

PATENT NO. : 7,607,264 B2
APPLICATION NO. : 11/014263
DATED : October 27, 2009
INVENTOR(S) : James D. Weber It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1349 days.

Signed and Sealed this

Twelfth Day of October, 2010

David J. Kappos

David J. Kappos
*Director of the United States Patent and Trademark Office*